United States Patent [19]

Wheeldon et al.

[11] 3,948,722

[45] Apr. 6, 1976

[54] WARP KNITTED PAPER MAKER'S FELT AND METHOD FOR THE PRODUCTION THEREOF

[75] Inventors: John Brian Wheeldon; David Gill, both of Blackburn, England

[73] Assignee: Scapa-Porritt Limited, Blackburn, England

[22] Filed: July 29, 1974

[21] Appl. No.: 492,676

[30] Foreign Application Priority Data

July 28, 1973 United Kingdom..... 36022/73

[52] U.S. Cl. ..... 162/289; 34/95; 66/192; 66/195; 139/383 A; 162/358; 428/254

[51] Int. Cl.[2] ..... D21F 7/08

[58] Field of Search ..... 66/84 A, 192, 193, 195, 66/202; 162/DIG. 1, 358, 289; 28/74 R; 161/89; 139/383 A; 34/95; 428/227, 254

[56] References Cited

UNITED STATES PATENTS

| | | | |
|---|---|---|---|
| 2,755,535 | 7/1956 | Schoenberger | 66/202 |
| 2,968,085 | 1/1961 | Matthews | 161/89 |
| 2,983,985 | 5/1961 | Helland | 161/89 |
| 2,983,986 | 5/1961 | Helland | 161/89 |
| 2,996,786 | 8/1961 | Helland | 161/89 |
| 3,523,432 | 8/1970 | Vajda et al. | 66/85 A |
| 3,642,561 | 2/1972 | Grobner | 66/202 |
| 3,653,105 | 4/1972 | Klaeui | 66/85 A |
| 3,690,126 | 9/1972 | Reiners et al. | 66/84 A |
| 3,732,707 | 5/1973 | Fürst | 66/84 A |
| 3,756,043 | 9/1973 | Kemter | 66/84 A |

*Primary Examiner*—S. Leon Bashore
*Assistant Examiner*—Richard V. Fisher
*Attorney, Agent, or Firm*—Shoemaker and Mattare

[57] ABSTRACT

A dimensionally stable warp knitted paper maker's felt includes a plurality of interlocked yarns having a weight per unit length equivalent to at least 500 denier. Laid-in yarns and/or resin may be used to impart the desired stability to the felt.

13 Claims, No Drawings

WARP KNITTED PAPER MAKER'S FELT AND METHOD FOR THE PRODUCTION THEREOF

The invention relates to improved paper machine "clothing" commonly referred to as "felts" and a method of making same.

In the art of papermaking two particular types of felt are used, the first type is used as a conveyor and water absorber in the press part of the machine. This type is referred to in the industry as a "Wet Felt". The second type is used in the thermal drying of paper on the papermachine and this type is positioned on the machine to increase the normal pressure of paper sheet onto heated cylinders which provide the heat for the drying of the paper. The second type is referred to as a "Dryer Felt" and other structures highly permeable to the passage of air are referred to as "Dryer Fabrics", "Dryer Screens" or "Mesh Dryers". Such structures and dryer felts are generally collectively known in the art and will herein be referred to as "Dry End Felts".

The invention refers particularly to improvements in Dry End Felts but may not be confined only to these.

Dry End Felts as conventionally constructed and finished comprise a woven structure of wool or cotton or wool-synthetic or cotton-synthetic or wholly synthetic materials and thereafter subjected to processes to provide the material with adequate stability for satisfactory performance on the papermachine. In some cases this stability can be achieved with a chemical treatment.

These felts have widths from the small felts of 60 inches or less to the very large felts of 360 inches and above and have lengths of 20 feet to beyond 250 feet. The large size and variety of dimensions has resulted in the felts being custom made, and hence they are expensive to manufacture.

The use of the felt on the papermachine requires a structure which is both dimensionally stable and has a high resistance to flexural fatigue and abrasion.

Knitted fabrics are well known and have met with widespread application in the clothing and allied fields, the context being those which enable advantage to be taken of the inherent stretch and recovery characteristics of the fabrics. There has been little, if any, significant use of knitted fabrics in the context of industrial fabrics.

A prime requirement of a paper makers' felt is that such felt be dimensionally stable, especially in the movement direction of the felt, but prima facie this requirement cannot be satisfied by knitted fabrics in view of the inherent stretch and recovery features of such fabrics.

The present invention is predicated upon the appreciation that despite indications to the contrary it is possible not only to utilise knitted fabrics as paper makers' felts, but to produce felts which are eminently suitable for use in their intended context.

According to the present invention a papermachine felt is characterized in that it comprises a warp knitted structure the said structure including multifilament yarns of at least 500 denier or staple monofilament yarns of an equivalent weight per unit length. The structural stability of the warp knitted structure may be achieved by laying in straight yarns in either or both of the weft and warp directions.

The invention also includes the method of producing a paper makers' felt as aforesaid.

In the production of a woven structure the cost of production increases as the cloth width increases due to the speed of weaving reducing. For example, a loom on which a woven structure is produced can operate at and above 60 weft insertions per minute on cloths of 100 inches wide whereas for cloths of 380 inches wide the speed of weft insertions can be as low as 30 per minute. In warp knitting the production speed is largely independent of width and production speeds are approximately eight times higher at 60 inches and 16 times faster at 380 inches, thus giving to the warp knitted fabric a substantial cost advantage as compared with equivalent woven fabrics.

It is often required that a dryer fabric have a low resistance to the passage of air transversely through its structure. With a woven cloth, this effect is produced in a variety of ways. For example, it is known to weave a loose structure and subsequently stabilise such structure with chemical treatment. In alternative procedures special rigid yarns are included, or the woven structure is needled, all for the purposes of producing the same end result, namely a stable dryer fabric having a low resistance to the passage of air. If desired, any of these procedures may be combined, in whole or in part. A warp knitted structure produced in accordance with this invention is inherently permeable to the transverse passage of air and hence a stable permeable felt can be produced which can subsequently be chemically treated or not or needled or not as, the application requires.

In many cases the woven structure which is presently used for papermachine dryer felts is such that at the crossover points of the yarns, knuckles are formed which are susceptible to abrasive wear. A warp knitted structure can be designed to give a smoother surface using the same component yarns, whilst also having a higher flexural resistance and hence a longer service life.

Thus, by careful selection of the structure and of the yarns used it has been found that a structure having a stability adequate to the application thereof to the field of paper making and the like can be produced when using conventional warp knitting processes. For example trial warp knitted structures have been produced suitable for Dry End Felts which have an initial modulus of 2,000 Kg per 2.5 cm compared with an initial modulus for a successful woven Dry End Felt of 1,500 Kg per 2.5 cm.

An example of a structure constructed in accordance with the present invention is provided by warp knitting patterns described below on a double needle bar warp knitting machine wherein the front needle bar is designated Needle Bar A and the back needle bar is designated Needle Bar B and the machine has four fully set, ground guide bars numbered in sequence 1, 2, 3 and 4. To define a structure it is necessary to use one of the normally accepted knitting notations where the space before the first needle is designated 0 the space between the first and second needle 2 the space between the second and third needle as 4 (et seq.). Using the above notation for the guide bar movements the following structure can be produced having the required properties for Dry End Felts.

| | |
|---|---|
| Bar 1 | Knitting on Needle Bar A 2-0/2-2/2-4/4-4/4-6/4-4/4-2/2-2// |
| Bar 2 | Knitting on Needle Bar B 2-2/2-0/2-2/2-4/4-4/4-6/4-4/4-2// |
| Bar 3 | Knitting on Needle Bar A 4-6/4-4/4-2/2-2/2-0/2-2/2-4/4-4// |

-continued

| | |
|---|---|
| Bar 4 | Knitting on Needle Bar B 4-4/4-6/4-4/4-2/2-2/2-0/2-2/2-4// |

The yarns used in this design were

| | |
|---|---|
| Bar 1 | 1000 denier polyester |
| Bar 2 | 600 denier polyamide |
| Bar 3 | 600 denier polyamide |
| Bar 4 | 1000 denier polyester |

A further example of a suitable structure is using five instead of four fully set ground guide bars where greater range of structures can be created. For example:

| | |
|---|---|
| Bar 1 | 2-0/2-2/2-4/4-4/4-6/4-4/4-2/2-2// |
| Bar 2 | 4-6/4-4/4-2/2-2/2-0/2-2/2-4/4-4// |
| Bar 3 | 2-0/2-0/8-10/8-10/2-0/2-0/8-10/8-10// |
| Bar 4 | 4-4/4-6/4-4/4-2/2-2/2-0/2-2/2-4// |
| Bar 5 | 2-2/2-0/2-2/2-4/4-4/4-6/4-4/4-2// |

In the sample produced the following yarns were used.

| | |
|---|---|
| Bar 1 | 1500 denier polyester |
| Bar 2 | 420 denier polyamide |
| Bar 3 | 750 denier polyester |
| Bar 4 | 420 denier polyamide |
| Bar 5 | 500 denier polyester |

However, the same structures can be made using other deniers and other materials such as polypropylene, wool cotton, glass, metal, asbestos, acrylic or any combination thereof. However, in order to ensure adequate strength, some, at least, of the yarns will be of 500 denier or greater or of an equivalent weight per unit length. Monofilament yarns have been used in these and other structures, thus adding to the stiffness of the material. Other structures can be used using more or less than the number of guide bars as given in the two examples above.

In addition to the cost advantage previously referred to, producing a paper makers' felt by means of a warp knit process offers the further advantage of enabling a felt to be produced to any desired width as a practical operation on a knitting machine of a width greater than that of the widest fabric required, whereas in the case of a weaving loom the minimum widths which can be woven on a given loom as a practical matter are related to the width of the loom.

Whilst a necessary degree of stability can be achieved from "laid-in" yarns in both or either of the warp and weft directions it being assumed that the wales are knitted tight, a fabric having such "laid-in" yarns may be stabilised still further by subjecting the same to a resin treatment of a conventional kind.

The fabric is rendered resistant to chemical and heat degradation by suitably resin treating the same, as is known in the art in connection with woven fabrics.

The yarns to be used may be high denier multifilaments as in the examples, or they may be monofilament or staple yarns of an equivalent weight per unit length, or any combination thereof.

We claim:

1. In a paper making machine having a paper maker's felt therein for supporting paper during the manufacture of the paper, the improvement comprising a dimensionally stable warp knitted paper maker's felt, said warp knitted paper maker's felt including a plurality of interlocked yarns having a weight per unit length equivalent to at least 500 denier.

2. A paper maker's felt as claimed in claim 1, wherein a resin finish is on said felt to impove the structural stability thereof while providing resistance of the felt to chemical and/or heat degradation.

3. A paper maker's felt as claimed in claim 1, wherein the yarns comprise multifilament yarns.

4. A paper maker's felt as claimed in claim 1, wherein the yarns comprise staple yarns.

5. A paper maker's felt as claimed in claim 1, wherein the yarns comprise monofilament yarns.

6. In a paper making machine having a paper maker's felt therein for supporting paper during the manufacture of the paper, the improvement comprising a dimensionally stable warp knitted paper maker's felt, said warp knitted paper maker's felt including a plurality of interlocked yarns having a weight per unit length equivalent to at least 500 denier, and said felt being resin treated to improve the structural stability of the felt.

7. In a paper making machine having a paper maker's felt therein for supporting paper during the manufacture of the paper, the improvement comprising a dimensionally stable warp knitted paper maker's felt, said warp knitted paper maker's felt including a plurality of interlocked yarns having a weight per unit length equivalent to at least 500 denier, and a plurality of substantially straight yarns laid-in in at least one of the warp and weft directions to impart at least a part of the desired stability to the felt.

8. A paper maker's felt as claimed in claim 7, wherein the straight yarns extend in the warp direction.

9. A paper maker's felt as claimed in claim 7, wherein a resin finish is on said felt to improve the structural stability thereof.

10. The method of producing a paper maker's felt, including the steps of warp knitting yarns to provide a warp knitted fabric, said yarns including yarns of at least 500 denier, treating said fabric to yender it dimensionally stable in at least one of the warp and weft directions, and using said warp knitted fabric as a paper maker's felt in a paper making machine.

11. The method as claimed in claim 10 including the step of laying in straight weft yarns during knitting thereby to impart a structural stability to the fabric.

12. The method as claimed in claim 10 including the step of including straight yarns extending in the warp direction thereof during knitting.

13. The method as claimed in claim 10 wherein the treating step includes resin treating the fabric to improve the structural stability thereof while providing a chemical and/or heat degradation resistance thereto.

* * * * *